US006655456B1

(12) United States Patent
Yokley et al.

(10) Patent No.: US 6,655,456 B1
(45) Date of Patent: Dec. 2, 2003

(54) LINER HANGER SYSTEM

(75) Inventors: John M. Yokley, Kingwood, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 14 days.

(21) Appl. No.: 09/943,854

(22) Filed: Aug. 31, 2001

Related U.S. Application Data

(60) Provisional application No. 60/292,049, filed on May 18, 2001.

(51) Int. Cl.[7] ..... E21B 43/10

(52) U.S. Cl. ..... 166/208; 166/382; 166/216

(58) Field of Search ..... 166/382, 208, 166/216, 123, 138

(56) References Cited

U.S. PATENT DOCUMENTS

| | | | | |
|---|---|---|---|---|
| 3,420,308 A | | 1/1969 | Putch | |
| 3,818,987 A | * | 6/1974 | Ellis | 166/134 |
| 3,893,717 A | | 7/1975 | Nelson | |
| 3,946,807 A | | 3/1976 | Amancharla et al. | |
| 3,999,604 A | | 12/1976 | Amancharla et al. | |
| 4,051,896 A | | 10/1977 | Amancharla et al. | |
| 4,281,711 A | * | 8/1981 | Braddick et al. | 166/118 |
| 4,311,194 A | * | 1/1982 | White | 166/120 |
| 4,468,055 A | | 8/1984 | Reimert | |
| 5,026,097 A | | 6/1991 | Reimert | |
| 5,586,601 A | * | 12/1996 | Pringle | 166/212 |
| 5,857,524 A | * | 1/1999 | Harris et al. | 166/382 |

OTHER PUBLICATIONS

Otis Composite Catalog, "Liner Hanger Equipment and Services", (1986–1987).

* cited by examiner

*Primary Examiner*—Frank Tsay
(74) *Attorney, Agent, or Firm*—Loren G. Helmreich; Browning Bushman P.C.

(57) ABSTRACT

There is disclosed a system in which a liner is lowered into and landed within an outer casing. The casing includes a casing joint having upwardly facing landing shoulders formed about its bore, and the liner has a recess thereabout which receives a "C" shaped hanger carried in a retracted position as it is lowered into the bore. The hanger has teeth about it which are arranged to seat upon the landing shoulders when the hanger is released to expand against the bore so that its teeth may be lowered onto the landing surface.

6 Claims, 6 Drawing Sheets

LINER HANGER SYSTEM

This application claims the benefit of provisional application No. 60/292,049, filed May 18, 2001.

This invention elates to a liner hanger system wherein a liner is to be suspended within an outer casing in the well bore as the liner is lowered into the outer casing for that purpose. As well known in the art, when the liner is so landed, it is cemented in place by means of cement pumped downwardly through and upwardly through the annulus between the casing, and then packed off within the outer casing.

A typical installation of this type, wherein the liner is suspended with the use of slips, is shown and described in Provisional Application No. 60/292,049, filed May 18, 2001, entitled Liner Hanger System, and assigned to the assignee of the present invention.

Other hangers for this purpose, i.e., hanging an inner casing within an outer casing, have locking elements adapted to be expanded into matching locking grooves formed in the outer casing. In some cases, the locking elements are adapted to be spring biased into matching grooves formed in the outer casing. However, these springs are susceptible to breaking or other malfunctions. This is especially true since the hanger often comprises a large number of intricate parts which are expensive to replace, and which require a delay in the overall well operations. In still other cases, the hangers having only a single latching part for fitting within a single groove, thus limiting its load carrying capacity.

The primary object of this invention is to provide a casing hanger system which overcomes these and other problems inherent in prior hangers for such systems.

These and other objects are accomplished, in accordance with the illustrated embodiment of this invention, by a liner hanger system comprising a joint of casing adapted to be connected as part of an outer casing installed within a wellborn, and a liner adapted to be lowered and landed within the outer casing. The bore of the casing joint has a polished bore and vertically spaced, upwardly facing landing surfaces formed therein, and the liner includes a tubular body having a recess formed about its body, and a hanger element comprising a circumferentially expandible and contractible C-ring disposed within the recess. The ring has teeth on its outer diameter for landing on the landing surfaces of the casing joint when in its expanded portion, and upon relative vertical movement with respect to the liner, is expanded outwardly against the polished bore. Upon continued relative movement of the liner and ring, the teeth will move into a position in which they expand further outwardly into landed positions on the landing surfaces to permit the liner to be suspended therefrom.

IN THE DRAWINGS

Figure 1:
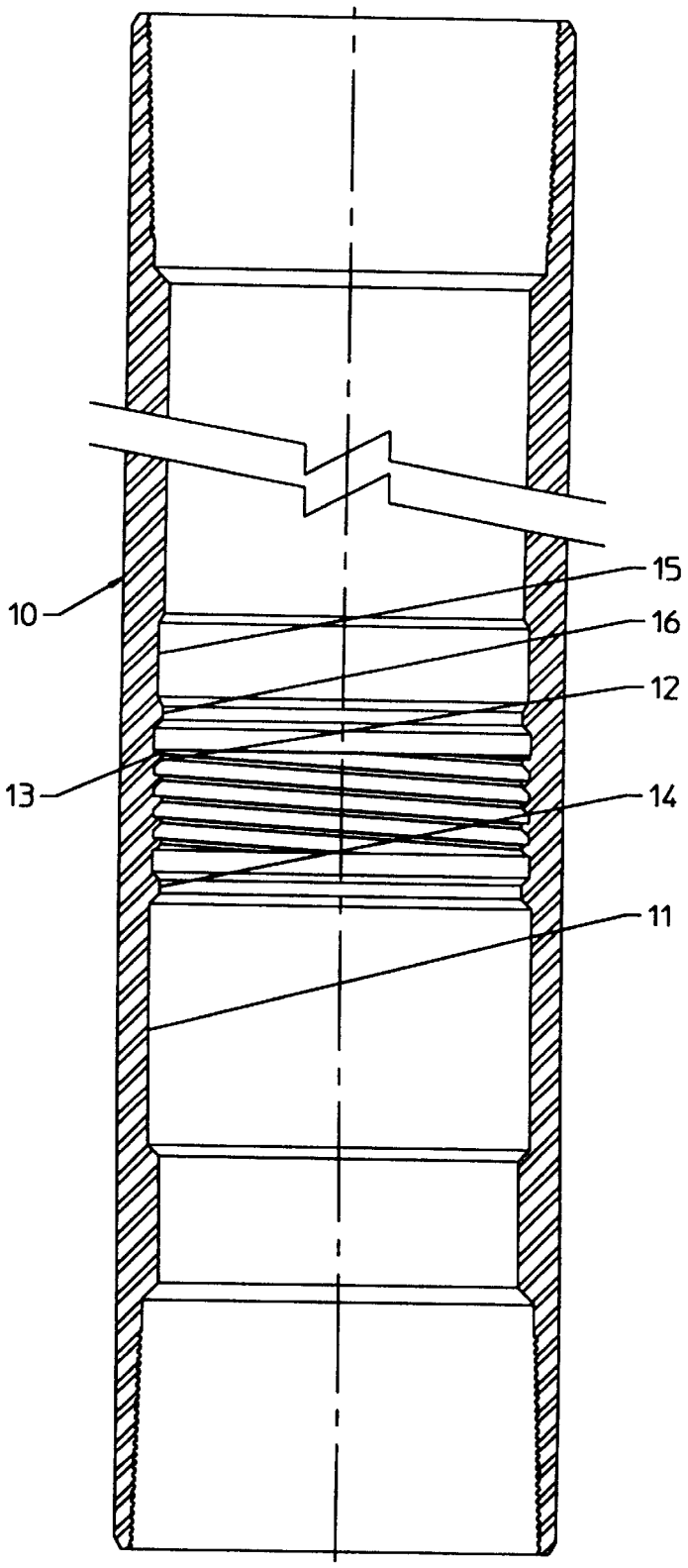
FIG. 1 is a vertical sectional view of the outer casing joint having its bore configured to cooperate with a hanger mounted on an inner casing or liner as it is lowered into the outer casing.

With reference now to FIG. 1, the joint 10 of the outer casing section is threaded at its upper and lower ends to permit it to be connected as part of the outer casing installed in the well bore, as in the liner hanger system referred to in the aforementioned Provisional Application. The polished bore of the casing section has an annular recess 11 in its lower portion, and a series of vertically spaced, upwardly facing landing shoulders 12 above the recess 11 and separated therefrom by annular restriction 14. There is another annular recess 15 formed in the bore above and separated from the landing surfaces 12 by means of an upper restriction 16 above an annular recess 13. The restrictions and landing shoulder are of essentially the same diameter of the polished bore above them.

Figure 2:
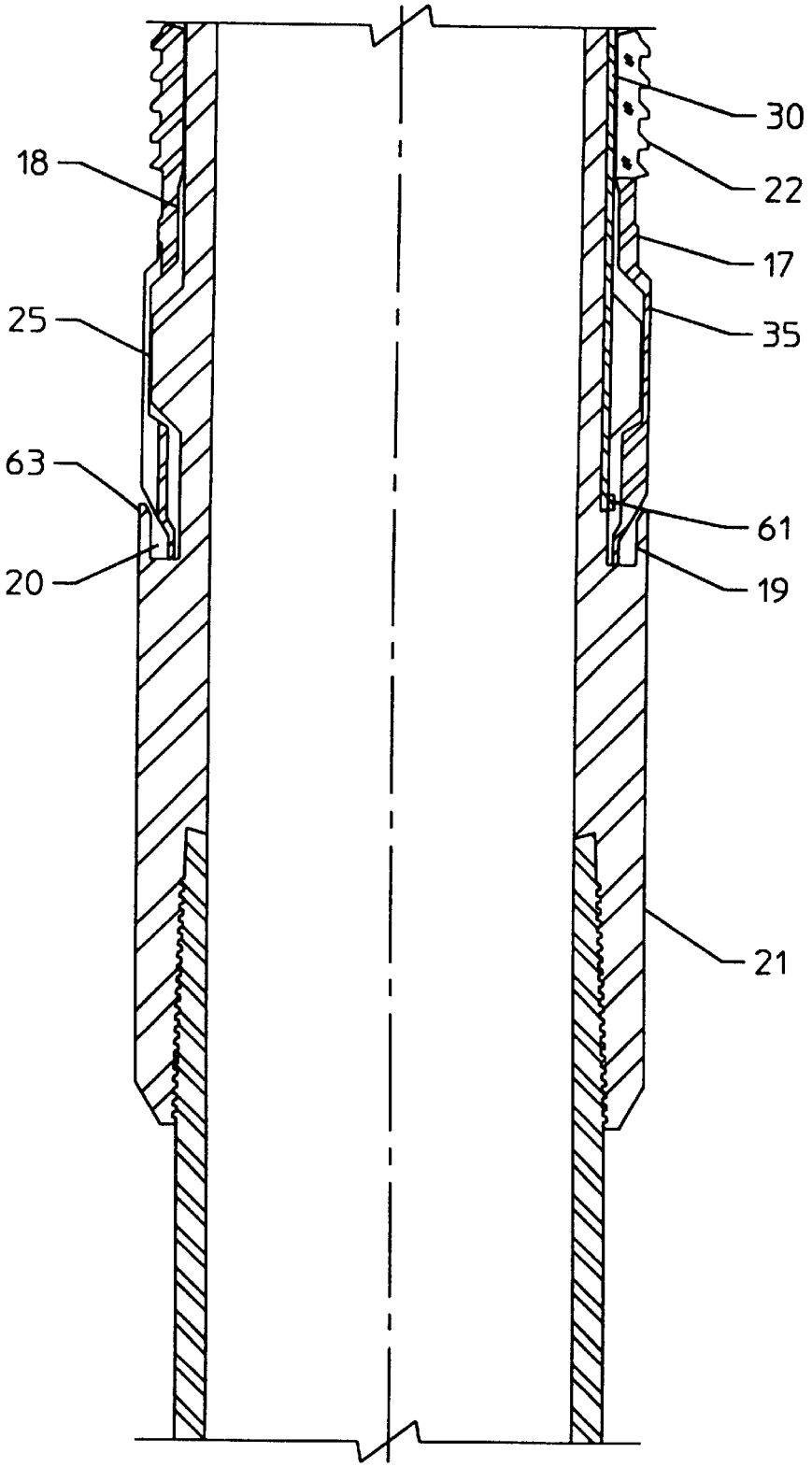
FIG. 2 is a view of the liner with the hanger mounted thereon for landing within the profiles in the outer casing.
Figure 2A:
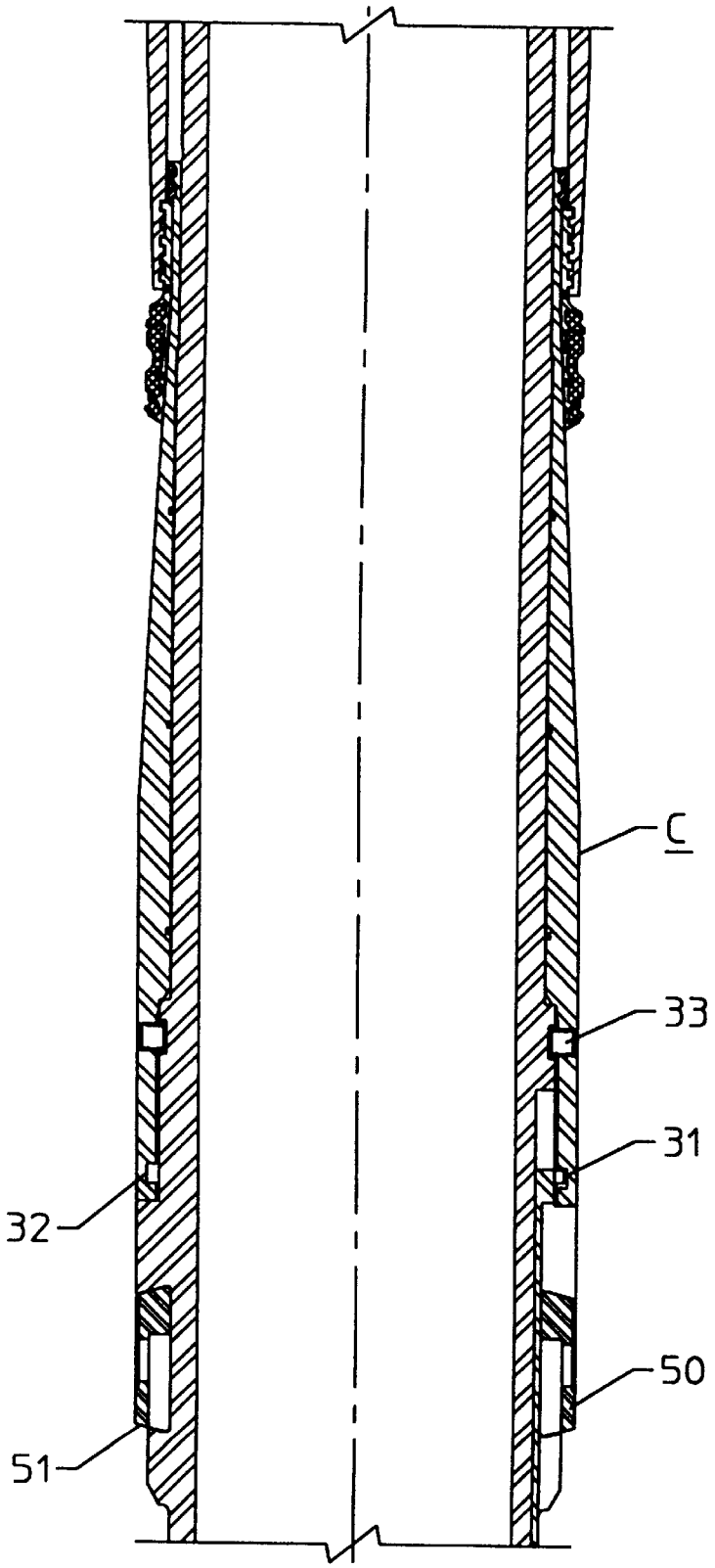

Hanger 17 is shown in FIG. 2 to be carried within a recessed portion 18 about the liner L which, as previously described, may be for the purpose disclosed in the above noted Provisional Application. The hanger 17 is a C ring split about its circumference in position to be urged circumferentially outwardly from a normally contracted position to engage the inner diameter of the casing when expanded, but held in its contracted position, as shown, as the liner is run into the outer casing. In this position, its lower end 20 is adapted to be received within a groove 19 in the upper end of an enlarged outer diameter portion 21 of the liner.

The upper end of the hanger has teeth 22 formed thereabout in vertically spaced relation corresponding to the landing surfaces 12 of the casing and fitting within recess 18 about the liner. The toothed section and lower end of the ring are connected by an outwardly enlarged cylindrical portion 35 whose inner surface engages the outer surface of enlargement 25 about the liner.

As will be described and shown in FIG. 3, the hanger is adapted to be raised relative to the liner to release it for expansion outwardly into engagement with the polished bore of the outer casing. Thus, liner hanger system includes a suitable mechanism to raise the hanger out of its retained position, to free its lower end from groove 19. As shown in the Provisional Application, this may be accomplished by raising the hanger by means of tie bars 30 connected at their upper ends to a cone C over which a packing element is adapted to be lowered to set it against the outer casing. The tie bars extend through vertical slots in the recessed portion of the liner, and have an outer flange 31 releasably connected in a groove 32 about a lower extension of the cone C.

Figure 3:
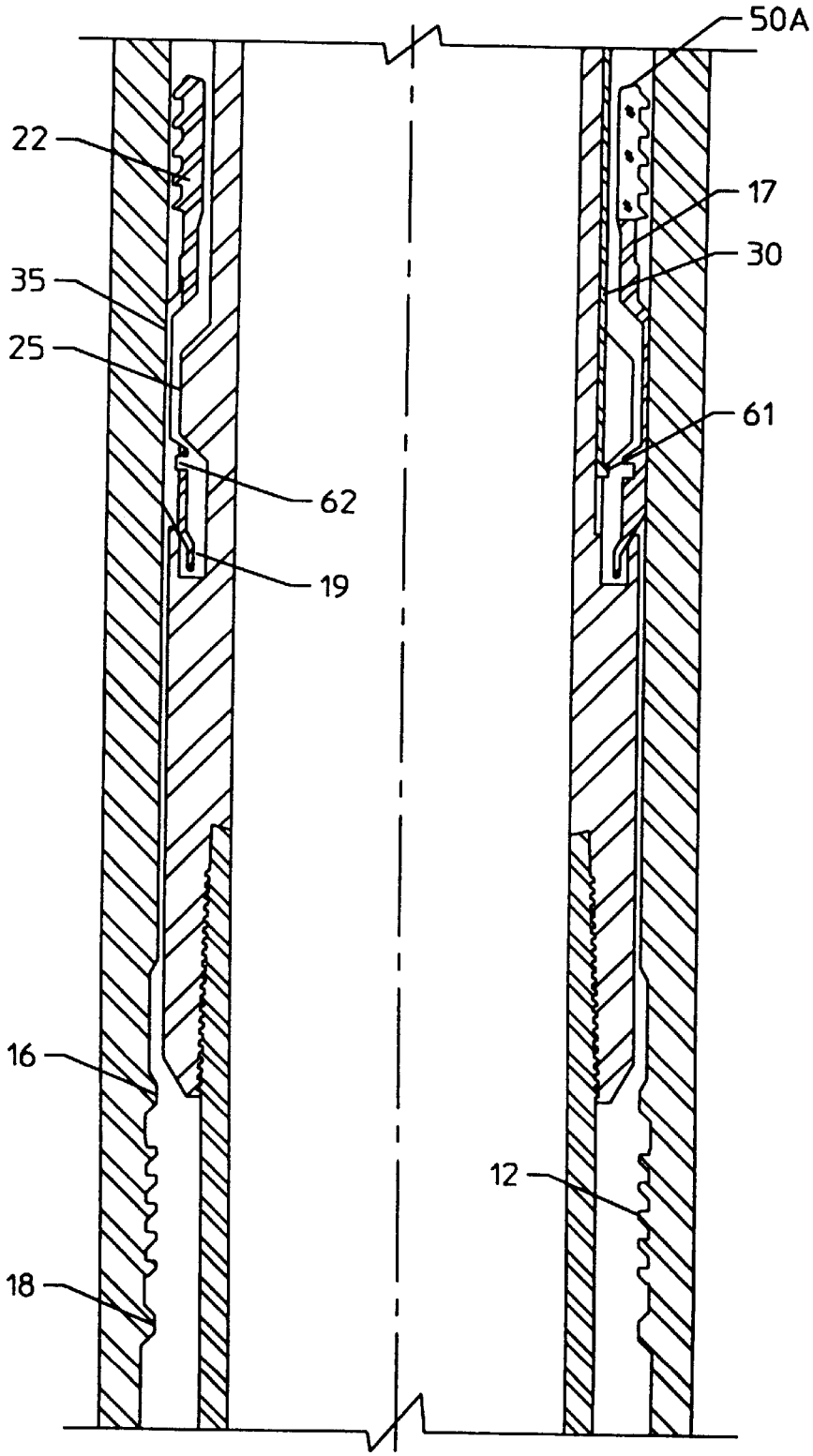
FIG. 3 is a view similar to FIG. 2, but showing the liner and its hanger being lowered into the outer casing.
Figure 3A:
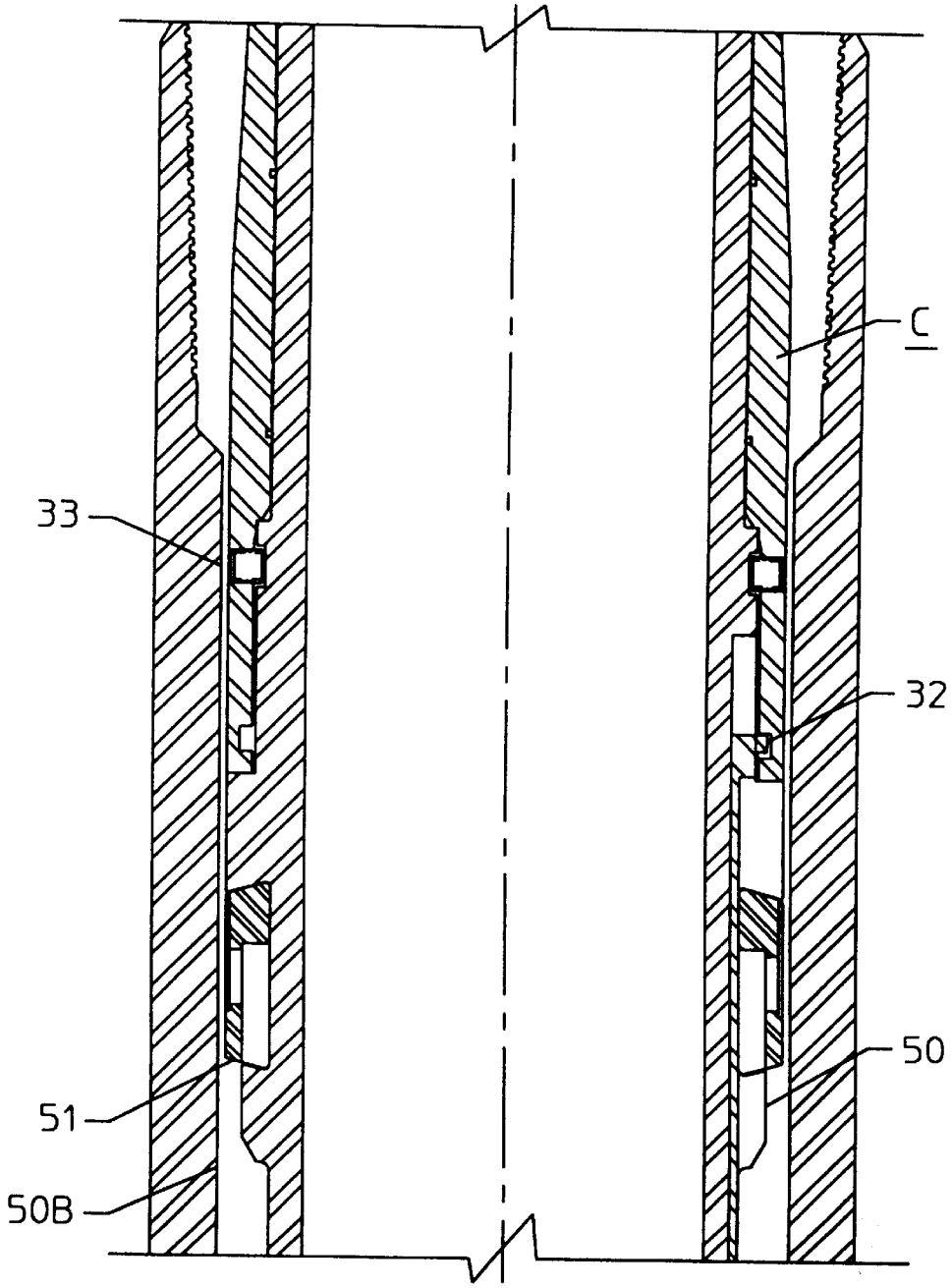
Figure 4:
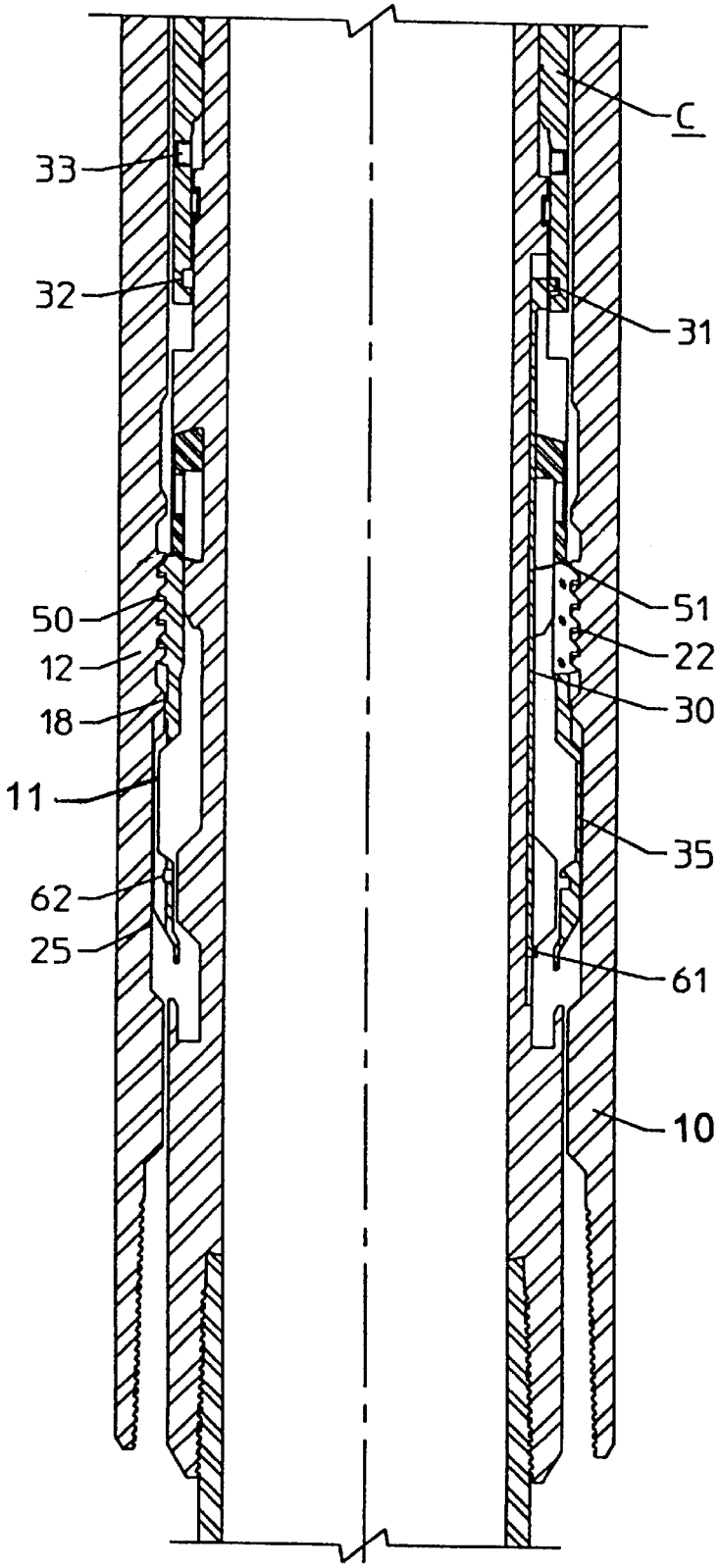
FIG. 4 is another similar view, but with the liner lowered further to cause its hanger to engage with the profile in the outer casing, and then lowered to a position to lock the hanger in position.

Thus, it will be seen, from a comparison of FIG. 3 and FIG. 4, that raising of the packer cone will raise the lower end of the hanger free from the retaining groove 19, and thus permit the hanger to expand outwardly to the position of FIG. 4. This then permits rib 61 on the lower end of the tie bar to disengage from groove 62 in the lower end of the hanger and release the tie bars from the hanger as it moves into its upper relative position with respect to the liner. This relative vertical movement between the liner and packer element cone has resulted from shearing of pin 33 releasably connecting them in the position of FIG. 2. This of course can be accomplished by raising of the packer cone relative to the liner, prior to lowering of the hanger into a position opposite the grooves forming landing surfaces in the bore of the outer casing.

Upon lowering of the hanger with the liner from the FIG. 3 to the FIG. 4 position, the lower radially enlarged section 35 of the hanger, which extends over the outer enlargement 25 of the liner, is free to move outwardly into the recess 11 in the outer casing. Thus, when lowered with the hanger to a position opposite the landing surfaces 12 within the outer casing, the lower end of the hanger is free from the groove about the liner, the teeth 22 about the upper end of the hanger are free to be expanded outwardly onto the landing surfaces, thus forming multiple shoulders on which to support the load of the liner within the outer casing. This outward expansion of the normally retracted hanger element has occurred after it has been lowered beneath the restriction 16 in the bore of the outer casing as the liner is lowered from its FIG. 3 to its FIG. 4 position.

Upon continued lowering of the liner, the hanger is expanded by enlargement 50 on the liner to force the hanger teeth 22 outwardly to maintain the hanger in its outer hanging position, as shown in FIG. 4. A downwardly facing shoulder 51 is formed on the outer diameter of the liner above the outward enlargement 50 so as to land on the upper end of the hanger, as shown in FIG. 4. The outward enlargement is moved into the inner diameter of the hanger, as shown in FIG. 4, by virtue of a tapered shoulder formed on its upper end slidable over an inwardly and downwardly tapered shoulder surface on the hanger.

As the hanger is moved downwardly into landed position, enlargement 35 thereabout beneath its teeth fits closely within the recess 11 in the outer casing bore so as to limit outward expansion of the hanger element once it is moved into hanging position.

An inwardly enlarged portion 60 on the lower end of the hanger, beneath its outwardly enlarged portion 35 moves over the outer diameter of the lower end of the liner, thereby cooperating with the enlargement 50 to maintain the hanger element in its outer hanging position.

What is claimed is:

1. A liner hanger system, comprising a joint of casing adapted to be connected as part of an outer casing installed within a wellbore, a liner adapted to be lowered within the outer casing, the bore of said casing joint having vertically spaced, upwardly facing upper and lower landing surfaces formed on an intermediate portion thereof, and a lower annular recess separated from the lower landing surface by a lower annular restriction, the said liner including a tubular body having a recess formed thereabout with an annular groove formed in its lower end, a hanger comprising a circumferentially expandible and contractible C-ring disposed within and closely about the liner recess when in its normally contracted portion, said C-ring having teeth formed thereabout for landing on the landing surfaces of the casing joint when in its expanded portion, and a lower end fitting within the groove when in its contracted portion to permit the liner to be lowered through the outer casing, said C-ring being expandable, upon relative vertical movement with respect to the liner, so as to release its lower end from the groove and thereby permit the ring to expand outwardly against the outer casing, whereby, upon continued relative movement of the liner and ring, the teeth will move into a position in which they expand outwardly into landed positions on the landing surfaces to permit the liner to be suspended therefrom, said liner having a downwardly facing shoulder for landing on the upper end of the C-ring when expanded and an outward enlargement beneath the shoulder to fit within the upper end of the ring so as to hold the ring expanded.

2. As in claim 1, including said part surrounding and vertically moveable with respect to the liner, and a tie bar guidably reciprocable within the liner recess radially inwardly of the ring and having its upper end connected, and said tie bar and C-ring having radially extending parts which connect the tie bar to the ring to raise the ring out of the groove and, when the ring is so raised, are released from one other to permit the liner to be lowered with respect to the ring.

3. As in claim 2, wherein the liner recess has a vertical slot to receive the tie bar and a stop surface on its lower end to be engaged with the lower end of this tie bar prior to its being raised to lift the lower end of the ring from the groove in liner recess.

4. As in claim 1, wherein the bore of the casing joint also has an upper annular recess separated from the upper landing surface by an upper annular restriction.

5. As in claim 1, wherein the liner also has a lower outward enlargement thereabout above the groove for disposal within the lower end of the expanded ring.

6. As in claim 1, wherein the bore of the casing joint has a polished bore above the landing surface.

* * * * *